US005217842A

United States Patent [19]

Kojima et al.

[11] Patent Number: 5,217,842

[45] Date of Patent: Jun. 8, 1993

[54] SUPERHIGH CONTRAST NEGATIVE IMAGE FORMING PROCESS

[75] Inventors: Yasuhiko Kojima, Saitama; Naoki Obi, Tokyo; Yasuo Shigemitsu, Saitama, all of Japan

[73] Assignee: Dainippon Ink and Chemical, Inc., Tokyo, Japan

[21] Appl. No.: 761,549

[22] Filed: Sep. 18, 1991

[30] Foreign Application Priority Data

Sep. 19, 1990 [JP] Japan ..... 2-249678

[51] Int. Cl.[5] ..... G03C 1/06

[52] U.S. Cl. ..... 430/264; 430/266; 430/267; 430/436; 430/480; 430/487; 430/489; 430/603; 430/602; 430/448; 430/434

[58] Field of Search ..... 430/264, 266, 267, 436, 430/480, 487, 489, 603, 602, 448, 434

[56] References Cited

U.S. PATENT DOCUMENTS

| | | | |
|---|---|---|---|
| 2,688,549 | 7/1954 | James et al. | 430/480 |
| 3,549,364 | 12/1970 | Morse et al. | 96/29 |
| 3,826,654 | 7/1974 | Weiss et al. | 96/66 |
| 3,895,948 | 7/1975 | Shiba et al. | 430/614 |
| 3,901,709 | 8/1975 | Ebato et al. | 430/266 |
| 3,972,719 | 8/1976 | Vanreusel et al. | 430/266 |
| 4,001,020 | 1/1977 | Hayashi | 96/66.3 |
| 4,724,196 | 2/1988 | Shoji et al. | 430/266 |

FOREIGN PATENT DOCUMENTS

| | | | |
|---|---|---|---|
| 558528 | 6/1958 | Canada . | |
| 0136740 | 7/1985 | Japan | 430/436 |
| 1047951 | 3/1986 | Japan | 430/436 |
| 1098748 | 1/1968 | United Kingdom . | |
| 2027920 | 2/1980 | United Kingdom | 430/480 |

OTHER PUBLICATIONS

*The Theory of the Photographic Process*, Fourth Ed., 1977, p. 303, right column, lines 21–40.

*Primary Examiner*—Charles L. Bowers, Jr.
*Assistant Examiner*—Thomas R. Neville
*Attorney, Agent, or Firm*—Armstrong, Westerman, Hattori, McLeland & Naughton

[57] ABSTRACT

A process of forming superhigh-contrast negative images is disclosed. The process comprises the steps of imagewise exposing a substantially surface latent image-type silver halide photographic material which is spectrally sensitized with a sensitizing dye and then developing said photographic material with a developer, wherein said photographic material contains a heterocyclic thione compound and said developer comprises (a) an aminophenol derivative developing agent, (b) a reductone compound, (c) a quaternary ammonium salt, and (d) a compound represented by formula (I):

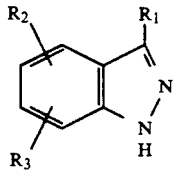

(I)

wherein $R_1$, $R_2$ and $R_3$, which may be the same or different, each represents a hydrogen atom, a nitro group, a halogen atom, or a cyano group, and wherein said development processing is carried out in the existence of at least one kind of a polyalkylene oxide or a derivative thereof. The process provides negative images of superhigh contrast having gamma over 10 substantially free from appearance of pepper.

15 Claims, No Drawings

SUPERHIGH CONTRAST NEGATIVE IMAGE FORMING PROCESS

FIELD OF THE INVENTION

The present invention relates to a process of forming negative images which is useful for the step of a photomechanical process for graphic art printing and has a very high contrast and a good dot quality.

BACKGROUND OF THE INVENTION

Since in a step of photomechanical process, the formation of sharp dot images or line images is required, an image-forming system showing very high contrast photographic characteristics (in particular, gamma of at least 10). Hitherto, for this purpose, a process of processing a lith-type silver halide photographic material comprising a silver chlorobromide emulsion having a silver chloride content of over 50 mol %, and more preferably over 70 mol % with a specific developer called as a "lithographic developer" containing only hydroquinone as a developing agent and having a very low free sulfite ion concentration (usually not more than 0.1 mol/liter) has been used. However, since for a lith-type silver halide photographic emulsion, a silver chlorobromide having a high silver chloride content must be used, it is difficult to attain a high sensitivity.

As other processes of obtaining high contrast negative images, there are processes using specific hydrazine derivatives disclosed in U.S. Pat. Nos. 4,168,977, 4,224,401, 4,241,164, 4,269,929, 4,311,781, 4,650,746, etc. According to these processes, by processing a surface latent image-type silver halide photographic material containing a specific hydrazine derivative (generally, an acylphenylhydrazine derivative) as a nucleating agent with a developer having pH of from 11.0 to 12.3, photographic characteristics having a superhigh contrast of over 10 in gamma and a high sensitivity are obtained. Since in these processes, a silver bromide emulsion or a silver chlorobromide emulsion having a high silver bromide content can be used, a high sensitivity can be achieved as compared to the case of using lith-type silver halide emulsion.

However, it has been found that the foregoing high contrast image-forming system using the hydrazine derivative has various defects. That is, when the foregoing image-forming system is used, high contrast negative images are obtained but, at the same time, it is accompanied by the formation of pepper (black pepper), which becomes a large problem for a photomechanical process. The pepper in photography means black sesame-like spots occurring in unexposed area, for example, an area to become an undeveloped area between a dot and a dot and the appearance of the pepper causes a trouble of greatly reducing the commercial value as a photographic light-sensitive material for a photomechanical process. Accordingly, various efforts have been made for the development of a pepper restraining technique, but the improvement in pepper susceptibility is frequently accompanied by the reduction of the sensitivity and gamma and, hence, it has been strongly desired to develop an image forming system capable of obtaining a high sensitivity and high contrast without being accompanied by the appearance of the pepper.

A second defect of the conventional high contrast image forming system is that a large amount of expensive hydroquinone must be used for keeping the activity of the developer constant. Since the sulfite ion concentration of the lithographic developer is low, the developer is easily air-oxidized to greatly consume hydroquinone which is the developing agent. In a high contrast image-forming system using a hydrazine derivative, it is allowed to add a sulfite of a high concentration to the developer, but since pH of the developer is high (from 11.0 to 12.3), the developer is liable to be air-oxidized to greatly consume hydroquinone.

Accordingly, for maintaining the developing activity of these developers, it is necessary to use a large amount of expensive hydroquinone or supplement hydroquinone consumed by air-oxidation to maintain the amount of hydroquinone in the developer at above a constant level, and hence the development of a high contrast image-forming system with a developer containing a less amount of hydroquinone or a developer not using hydroquinone as a developing agent has been desired.

On the other hand, a process of obtaining high contrast negative images using a developer containing the compound shown by formula (I) is disclosed in British Patent 2,027,920 but in the process, negative images of a superhigh contrast over 10 in gamma can not be obtained. Also, JP-A-1-130155 (the term "JP-A" as used herein means an "unexamined published Japanese patent application") discloses a process of using a dihydroxybenzene derivative developing agent but the process is not for solving the theme of this invention.

As a process of solving such a theme, it was disclosed in Japanese Patent Application No. 2-48022 that by developing an imagewise exposed substantially surface latent image-type silver halide photographic material spectrally sensitized by sensitizing dye(s) with a developer containing at least (1) an aminophenol derivative developing agent and (2) a reductone compound in the existence of at least one kind of a polyalkylene oxide or a derivative thereof, negative images with a very high contrast of over 10 in gamma and with less pepper are obtained. It is an utterly new and astonishing fact that a great increase of sensitivity and superhigh contrast negative images are obtained by the process and conditions disclosed in the aforesaid patent application. Although the detailed mechanism has not yet been clarified, it is considered that a certain high contrast causing reaction occurs in addition to an ordinary development reaction.

However, in the foregoing process, there is a problem that the development requires a substantially long time (e.g., 5 minutes at 20° C.), which is not practical as an image-forming condition.

Thus, as a process of employing a practical development condition, there is a process of adding both of a quaternary ammonium salt and the compound shown by the formula (I) to the developer as disclosed in Japanese Patent Application No. 2-139303 and a process of incorporating a heterocyclic thione compound in a surface latent image-type silver halide photographic material as disclosed in Japanese Patent Application No. 2-178649. In both the processes, negative images having no pepper and a high contrast can be obtained by practical development processing conditions, for example, at 27° C. for 1 minute and 45 seconds. However, when dot images were formed by means of a half tone screen using the foregoing image-forming processes and the dot qualities were comparatively investigated, it has been confirmed that the dot quality by the image-forming processes having improved development conditions is inferior to the dot quality by the image-forming process (Japanese Patent Application No. 2-48022) of processing for a longer development time, and also the development latitude for obtaining good dot images becomes narrower in the former case.

SUMMARY OF THE INVENTION

The object of this invention is, therefore, to provide an image-forming process for obtaining a good dot quality with a good development tolerance (an improved development latitude) in a process of forming superhigh-contrast negative images by, after imagewise exposing a substantially surface latent image-type silver halide photographic material spectrally sensitized with sensitizing dye(s), development processing the photographic material with a developer containing an aminophenol derivative developing agent and a reductone compound.

It has now been discovered that the foregoing object can be achieved by the process of the present invention as described hereinbelow.

That is, according to the present invention, there is provided a process of forming superhigh-contrast negative images which comprises the steps of imagewise exposing a substantially surface latent image-type silver halide photographic material which is spectrally sensitized with a sensitizing dye and then developing said photographic material with a developer, wherein said photographic material contains a heterocyclic thione compound and said developer comprises (a) an aminophenol derivative developing agent, (b) a reductone compound, (c) a quaternary ammonium salt, and (d) a compound represented by formula (I):

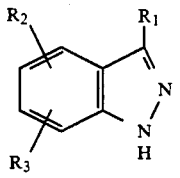

(I)

wherein $R_1$, $R_2$ and $R_3$, which may be the same or different, each represents a hydrogen atom, a nitro group, a halogen atom, or a cyano group, and wherein said development processing is carried out in the existence of at least one kind of a polyalkylene oxide or a derivative thereof.

DETAILED DESCRIPTION OF THE INVENTION

Then, the invention is described in detail.

The compounds represented by formula (I) being used in this invention can be synthesized by the methods described in *J. Chem. Soc.*, 1955, 2412(1955); *Chem. Ber.*, 43, 2543(1910); *Hetero-Cyclic Chem.*, 16, 1599(1979); *Org. Synth. Coll.*, Vol. 3, pages 475 and 660, published by Wiley & Sons (1955), etc.

Also, the compounds described, e.g., in JP-A-1-130155 and British Patent 2,027,920A can be used as the compound of formula (I).

Then, specific examples of the compound shown by formula (I) are illustrated below but the invention is not limited to these compounds.

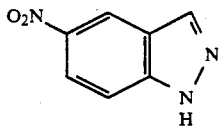

I-1

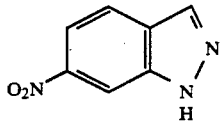

I-2

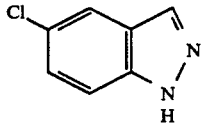

I-3

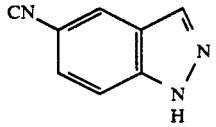

I-4

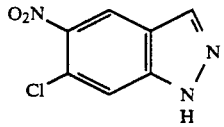

I-5

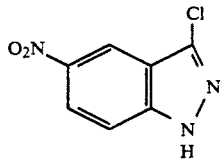

I-6

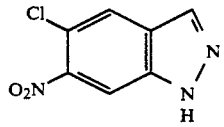

I-7

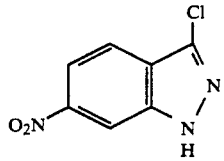

I-8

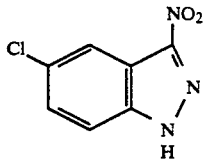

I-9

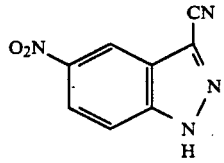

I-10

The compound shown by formula (I) is used in a developer and the content thereof is not more than 100 mg, and preferably in the range of from 0.5 mg to 10 mg per liter of the developer.

As the heterocyclic thione compound being used in this invention, there are an ethylenethiourea derivative represented by the following formula (II) and the tautomer thereof, and a tetrahydro-1,3,5-triazine-2-thione derivative represented by the following formula (III) or (IV):

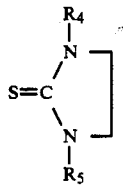

(II)

Tautomer of formula (II);

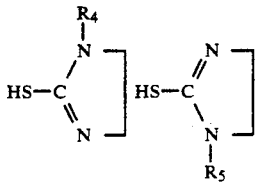

wherein $R_4$ and $R_5$ each represents a hydrogen atom, an alkyl group, an aralkyl group or a substituted or unsubstituted aryl group;

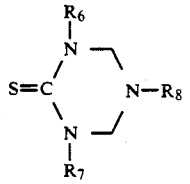

(III)

wherein $R_6$ and $R_7$ each independently represents a hydrogen atom or an alkyl group and $R_8$ represents a substituted or unsubstituted monovalent organic group.

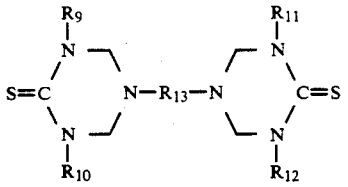

(IV)

wherein $R_9$, $R_{10}$, $R_{11}$, and $R_{12}$ each independently represents a hydrogen atom or an alkyl group and $R_{13}$ represents a substituted or unsubstituted divalent organic group.

The ethylenethiourea derivative shown by formula (II) or the tautomer thereof for use in this invention can be synthesized by the methods described in *Berichte der Deu. Chemi. Gesel.*, 24, 2191(1891) and *Dai Yuuki Kagaku* (*Organic Chemistry*), 15, 235(1958), published by Asakura Shoten, Japan.

In formula (II), the alkyl group preferably has from 1 to 4 carbon atoms and the aralkyl group preferably has from 7 to 10 carbon atoms. Further, the substituents for the substituted aryl group include a methyl group and an ethyl group.

Then, specific examples of the compound shown by formula (II) and the tautomers thereof are illustrated below but the invention is not limited to these compounds.

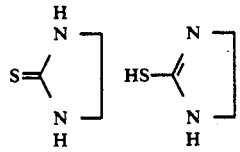

II-1 Tautomer of II-1

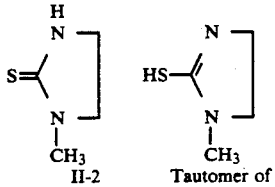

II-2 Tautomer of II-2

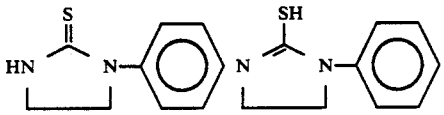

II-3 Tautomer of II-3

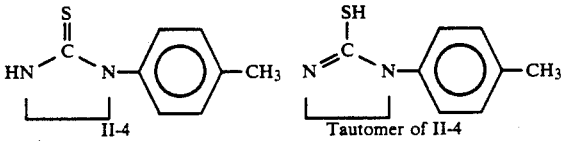

II-4 Tautomer of II-4

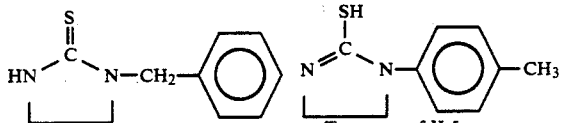

II-5 Tautomer of II-5

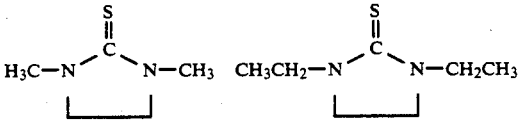

II-6 II-7

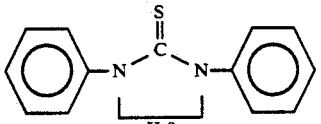

II-8

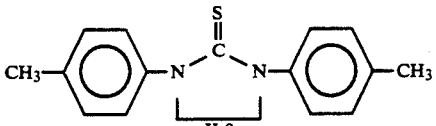

II-9

In formula (III), the alkyl group represented by $R_6$ and/or $R_7$ preferably has from 1 to 4 carbon atoms.

Examples of the substituted or unsubstituted monovalent organic group shown by $R_8$ in the compound of formula (III) for use in this invention are an unsubstituted alkyl group having from 1 to 20 carbon atoms, an unsubstituted aryl group having from 6 to 20 carbon atoms, an unsubstituted aralkyl group having from 7 to 20 carbon atoms, an unsubstituted cycloalkyl group, an unsubstituted heterocyclic residue, etc., and a substituted alkyl group, aryl group, aralkyl group, cycloalkyl group, heterocyclic residue, etc. with an alkyl group, a halogen atom, a hydroxy group, an alkoxy group, an amino group, a substituted amino group (shown by $R_{14}$—N—$R_{15}$; wherein $R_{14}$ and $R_{15}$ each represents a hydrogen atom, a methyl group, an ethyl group, a propyl group, a butyl group, etc.), a carboxy group, a carboalkoxyl group, an acylamido group, etc.

The compounds shown by formula (III) or (IV) can be produced by the methods described in *J. Am. Chem. Soc.*, 69, 2136(1947).

Then, specific examples of the compound shown by formula (III) are illustrated below but the invention is not limited to these compounds.

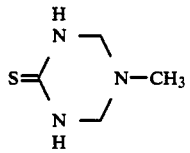

III-1

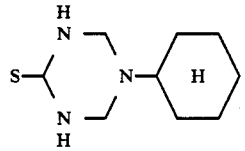

III-2

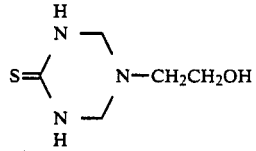

III-3

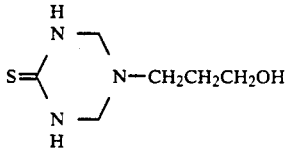

III-4

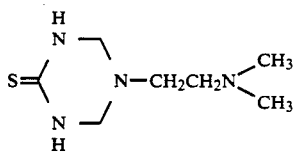

III-5

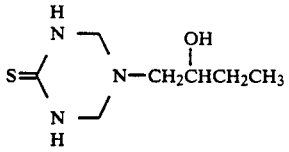

III-6

-continued

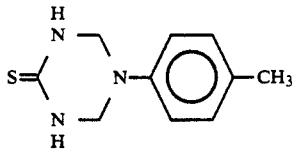

III-7

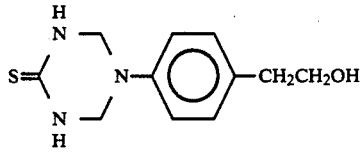

III-8

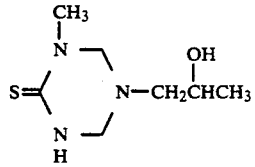

III-9

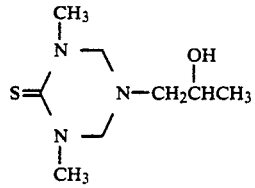

III-10

In formula (IV), the alkyl group represented by $R_9$, $R_{10}$, $R_{11}$, and/or $R_{12}$ preferably has from 1 to 4 carbon atoms.

As the substituted or unsubstituted divalent organic group shown by $R_{13}$ in the compound of formula (IV) for use in this invention, there are, for example, a substituted or unsubstituted alkylene group having from 1 to 12 carbon atoms, a substituted or unsubstituted oxyalkylene group, a substituted or unsubstituted polyoxyalkylene (e.g., polyoxyethylene, polyoxypropylene, and polyoxybutylene), etc. Also, the number-average molecular weight of the high molecular compounds shown by formula (IV) is preferably not more than 10,000 although the invention is not limited to these compounds.

Then, specific examples of the compound shown by formula (IV) are illustrated below but the invention is not limited to them.

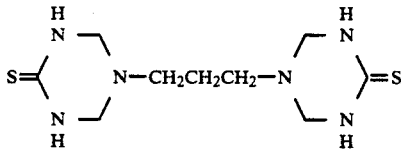

IV-1

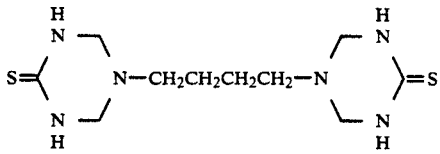

IV-2

-continued

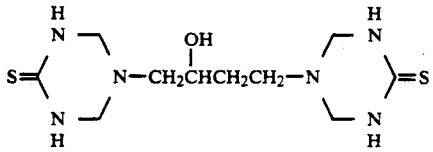

IV-3

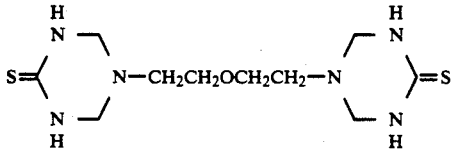

IV-4

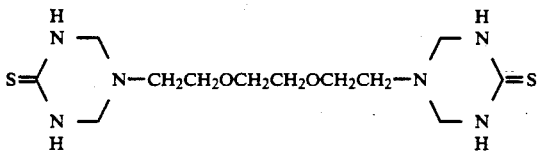

IV-5

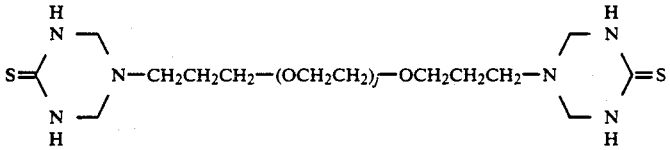

IV-6

$\overline{Mn}$ = 714

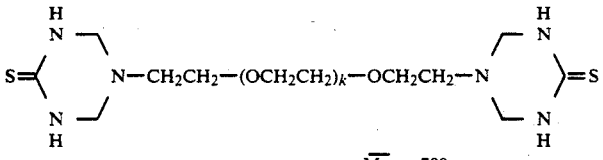

IV-7

$\overline{Mn}$ = 700

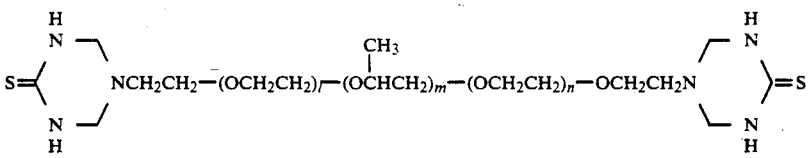

IV-8

$\overline{Mn}$ = 2,300

The heterocyclic thione compound for use in this invention being incorporated in the photographic light-sensitive material can be incorporated in either a surface latent image-type photographic emulsion or light-insensitive layers composed of a hydrophilic colloid, such as a protective layer, an interlayer, an antihalation layer, a filter layer, etc., but it is preferable that the compound is incorporated in the surface latent image-type photographic emulsion for use in this invention.

Also, for incorporating the heterocyclic thione compound, the compound is dissolved in water or an organic solvent miscible with water, such as, for example, alcohols, ketones, esters, amides, etc., and the solution can be added to the surface latent image-type photographic emulsion for use in this invention or a light-insensitive aqueous hydrophilic colloidal solution.

The addition amount of the heterocyclic thione compound for use in this invention to the photographic light-sensitive material is in the range of from $1\times10^{-8}$ mol to $1\times10^{-2}$ mol, and preferably from $1\times10^{-5}$ mol to $1\times10^{-3}$ mol per mol of silver halide. Also, the compound can be added thereto at any desired step during the production of the photographic light-sensitive material. For example, in the case of adding the compound to the silver halide emulsion, it is preferable to add the compound at any optional step after finishing second ripening and before coating.

As the polyalkylene oxide derivative being used in this invention, there are an addition polymer product of an alkylene oxide such as ethylene oxide, propylene oxide, etc., and at least one kind of compound selected from water, aliphatic alcohols, phenols, glycols, fatty acids, and organic amines; a condensation product of a polyalkylene oxide and at least one kind of the compound selected from the foregoing compound group; and a block copolymer of various alkylene oxides (e.g., ethylene oxide and propylene oxide). Also, the number-average molecular weight of the polyalkylene oxide derivative being used in this invention is from 500 to 20,000, and preferably from 1,000 to 10,000.

Then specific examples of several polyalkylene oxide derivatives for use in this invention are illustrated below.

$HO(CH_2CH_2O)_nH$ P-1

$\overline{Mn}$ = about 1,000–20,000

-continued $H(OCH_2CH_2)_l-(CH(CH_3)CH_2O)_m-(CH_2CH_2O)_nH$ P-2

$l + m + n = 50$, $m:l + n = 10:9$ $C_{12}H_{25}O(CH_2CH_2O)_{20}H$ P-3

$C_{16}H_{33}O(CH_2CH_2O)_{25}H$ P-4

$C_{16}H_{33}O(CH_2CH_2O)_{40}H$ P-5

P-6

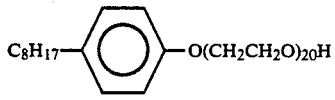

P-7

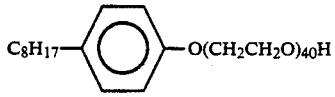

P-8

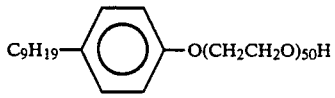

P-9

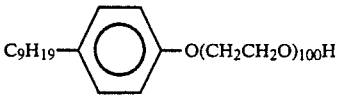

$C_{11}H_{23}COO(CH_2CH_2O)_{30}H$ P-10

The polyalkylene oxide derivative for use in this invention can be incorporated in either the photographic light-sensitive material or a developer. However, it is preferred to incorporate the compound in the photographic light-sensitive material.

In the case of incorporating the polyalkylene oxide derivative in the photographic light-sensitive material, the compound can be incorporated in either the surface latent image-type photographic emulsion or a light-insensitive hydrophilic colloidal layer, such as a protective layer, an interlayer, an antihalation layer, a filter layer, etc., but it is preferable to incorporate the compound in the surface latent image-type photographic emulsion.

For incorporating the polyalkylene oxide derivative being used in this invention in the photographic light-sensitive material, the compound is dissolved in water or an organic solvent miscible with water, such as alcohols, ketones, esters, amides, etc., and the solution can be added to either the surface latent image-type photographic emulsion or a light-insensitive aqueous hydrophilic colloidal solution.

The addition amount of the polyalkylene oxide derivative for use in this invention to the photographic light-sensitive material is in the range of preferably from 0.1 g to 5 g, and more preferably from 0.5 g to 3 g per mol of silver halide. Also, the compound can be added thereto any desired step during the production of the photographic light-sensitive material. For example, in the case of adding the compound to the silver halide emulsion layer, it is preferable to add the compound at any step after finishing second ripening and before coating.

In addition, when the polyalkylene oxide derivative for use in this invention is added to the developer for use in this invention, the effect of this invention can be obtained and in this case, the compound is added in an amount of from 0.1 g to 5 g per liter of the developer.

For the developer being used in this invention, an aminophenol derivative developing agent is used. As the aminophenol derivative developing agent, there are 4-aminophenol, 4-(N-methyl)aminophenol, 2,4-diaminophenol, N-(4-hydroxyphenyl)glycine, N-(2'-hydroxyethyl)-2-aminophenol, 2-hydroxymethyl-4-aminophenol, 2-hydroxymethyl-4-(N-methyl)aminophenol, and the hydrochlorides and sulfates of these compounds. Among them N-methyl-4-aminophenol sulfate (Metol) is particularly preferred.

The addition amount of the developing agent is from 0.5 g to 10 g, and preferably from 1 g to 3 g per liter of the developer.

As the reductone compound being used for the developer for use in this invention, endiol type compounds, enaminol type compounds, endiamine type compounds, thiol-enol type compounds, and enamine-thiol type compounds are generally known. Practical examples of these compounds are described in U.S. Pat. No. 2,688,549, JP-A-62-237443, etc. Synthetic methods of these compounds are also well known and are described in detail, e.g., Danji Nomura and Hirohisa Oomura, *Chemistry of Reductone*, published by Uchida Rokakuho Shin-Sha K.K., 1969.

Among these compounds, the reductone compounds which are particularly preferably used in this invention are the compounds represented by formula (V):

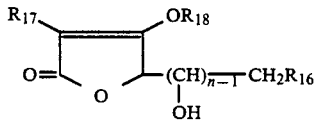

(V)

wherein $R_{16}$ represents a hydrogen atom or a hydroxy group; n represents an integer of from 1 to 4; $R_{17}$ represents a hydroxy group, an alkoxy group having from 1 to 4 carbon atoms, a thiol group, or an amino group; and $R_{18}$ represents a hydrogen atom or an alkyl group having from 1 to 4 carbon atoms.

Then, specific examples of the particularly preferred reductone compound for use in this invention are illustrated below.

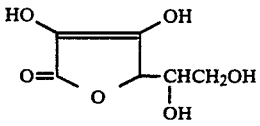

V-1

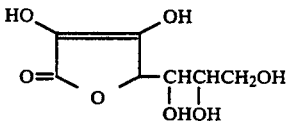

V-2

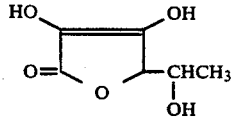

V-3

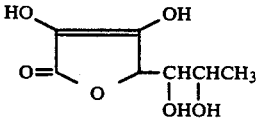

V-4

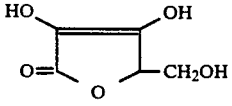

V-5

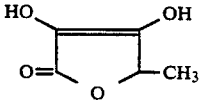

V-6

-continued

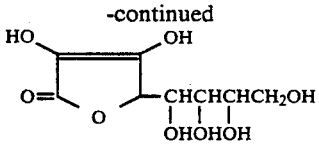

V-7

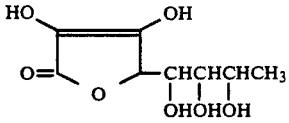

V-8

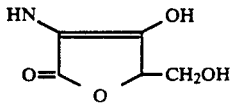

V-9

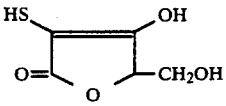

V-10

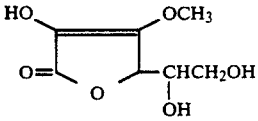

V-11

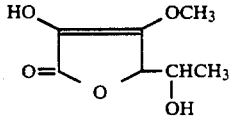

V-12

The reductone compounds for use in this invention can be used as the forms of alkali metal salts such as lithium salts, sodium salts, potassium salts, etc. It is preferable that the reductone compound is used in an amount of from 1 g to 50 g, and particularly from 5 g to 20 g per liter of the developer.

As the quaternary ammonium salt for use in this invention, compounds described, for example, in T. H. James, *The Theory of the Photographic Process*, 4th ed., page 423, published by Macmillan Co. can be used, and the quaternary ammonium salts which are preferably used in this invention are represented by the following formula (VI):

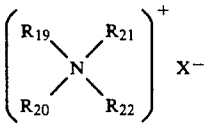

(VI)

wherein $R_{19}$, $R_{20}$, $R_{21}$ and $R_{22}$, which may be the same or different, each represents a straight chain or branched alkyl group having from 1 to 4 carbon atoms or an alkenyl group and $X^-$ represents an anion.

Specific examples of the preferred quaternary ammonium salt for use in this invention are illustrated below but the invention is not limited to them.

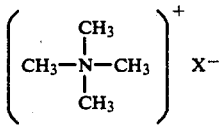

VI-1

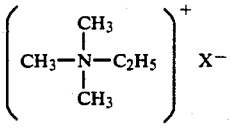

VI-2

-continued

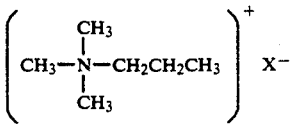

VI-3

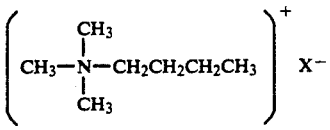

VI-4

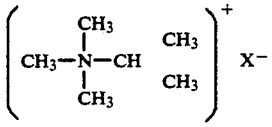

VI-5

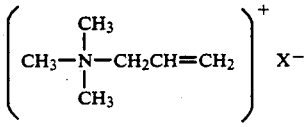

VI-6

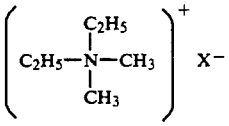

VI-7

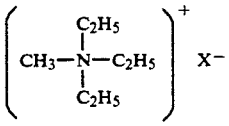

VI-8

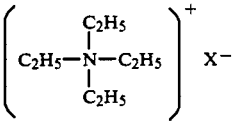

VI-9

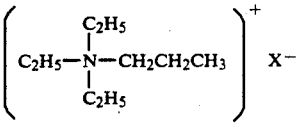

VI-10

The anion shown by $X^-$ in formula (VI) can be any stable counter anion to the ammonium compound and is preferably selected from the anions induced from the acids such as nitric acid, sulfuric acid, phosphoric acid, hydrochloric acid, hydrobromic acid, hydroiodic acid, methylsulfuric acid, perchloric acid, etc.

The quaternary ammonium salt is added to the developer and the addition amount is suitable in the range of from 0.1 mol to 0.001 mol, and particularly preferable in the range of from 0.01 mol to 0.05 mol per liter of the developer.

It is preferable that the developer for use in this invention further contains a preservative, a pH buffer, and an alkali agent in addition to the foregoing necessary components.

As the preservative, a sulfite can be used. As the sulfite which can be used in this invention, there are sodium sulfite, potassium sulfite, lithium sulfite, ammonium sulfite, sodium bisulfite, potassium bisulfite, potassium metabisulfite, etc. The addition amount of the sulfite is not more than 0.2 mol, and particularly preferably not more than 0.1 mol per liter of the developer.

The pH buffer is used for keeping pH of the developer at a constant value and keeping the activity and storage stability of the developer. As the pH buffer, sodium metaborate, sodium carbonate, potassium carbonate, sodium triphosphate, etc., is used.

The alkali agent is added for keeping pH of the developer above 9, and preferably at from 10 to 11. As the alkali agent, an ordinary water-soluble inorganic alkali salt such as sodium hydroxide, potassium hydroxide, sodium carbonate, potassium carbonate, potassium triphosphate, etc., can be used.

The developer for use in this invention can further contain, if necessary, a water-soluble acid (e.g., acetic acid and boric acid), an inorganic antifoggant (e.g., sodium bromide and potassium bromide), an organic antifoggant (e.g., 1-phenyl-5-mercaptotetrazole), and an organic solvent (e.g., ethylene glycol, diethylene glycol, and methyl cellosolve) in addition to the foregoing components and further, if necessary, the developer may contain a toning agent, a surfactant, an anti-foaming agent, a hard water softener, etc.

The pH value of the developer for use in this invention is preferably in the range of from 9 to 11.

The developing temperature is selected from the range of from 18° C. to 50° C., and preferably from 20° C. to 40° C.

Then, the silver halide photographic material being applied with the image-forming process of this invention is explained.

The silver halide photographic material for use in this invention has at least one emulsion layer composed of a substantially surface latent image-type silver halide emulsion. The term "substantially surface latent image-type silver halide emulsion" means a silver halide emulsion of a type of forming a latent image mainly on the surface of the silver halide grains and the silver halide emulsion has a property against to an internal latent image type silver halide emulsion.

There is no particular restriction on the halogen composition of the silver halide emulsion being used and silver chloride, silver chlorobromide, silver iodobromide, silver iodobromochloride, etc., can be used. It is preferred that the content of silver iodide in the silver halide emulsion is not more than 5 mol %, and particularly not more than 3%.

The silver halide grains for use in this invention can have a relatively broad grain size distribution but preferably has a narrow grain size distribution. In particular, a monodispersed silver halide emulsion is preferred wherein the grain sizes of the silver halide grains of 90% of the total silver halide grains are within ±40% of the mean grain size.

The average grain size of the silver halide grains for use in this invention is preferably not larger than 0.7 μm, and more preferably not larger than 0.4 μm. Also, the silver halide grains can have a regular crystal form such as cubic, octahedral, etc., or an irregular crystal form such as spherical, tabular, etc.

The silver halide emulsion for use in this invention can be prepared by any known method. That is, an acidic method, a neutral method, an ammoniacal method, etc., can be used and as a mixing process for a soluble silver salt and a soluble halide, a single jet process, a reverse mixing process, a double jet process, or a combination thereof can be used. Also, by using a process for keeping a constant silver ion concentration (pAg) in a liquid phase during precipitating silver halide crystals, that is, a pAg controlled double jet process (C.D.J. process) as one of the double jet process, monodispersed silver halide grains having a uniform crystal form and almost uniform grain size can be obtained.

In the step of the formation (precipitation) of silver halide grains or physical ripening thereof, a cadmium salt, an iridium salt, or a rhodium salt can exist in the system for increasing the contrast of the silver halide emulsion.

It is preferred that the content of the binder contained in the silver halide photographic emulsion layer in this invention is not over 250 g per mol of silver halide.

As the binder, gelatin is most preferably used but other hydrophilic colloids can be also used. For example, hydrophilic polymers such as albumin, casein, graft polymers of gelatin and other polymers, polyvinyl alcohol, polyacrylamide, etc., can be used.

The silver halide emulsion for use in this invention may not be chemically sensitized, but is usually chemically sensitized. As the chemical sensitization, a sulfur sensitization, a reduction sensitization, a noble metal sensitization or a combination thereof can be used. A particularly preferred chemical sensitization for the practice of this invention is a sulfur sensitization or a combination of a sulfur sensitization and a gold sensitization which is one of the noble metal sensitization.

For the sulfur sensitization, active gelatin, thiosulfate, thiourea, allylthiocarbamide, etc., can be used. For the gold sensitization, $HAuCl_4$, $Au(SCN)_2^-$ salt, or $Au(S_2O_3)_2^{3-}$ salt can be used.

The silver halide emulsion for use in this invention is spectrally sensitized using one or more kinds of sensitizing dyes. As the sensitizing dye, cyanine dyes, merocyanine dyes, styryl dyes, hemicyanine dyes, holopolar cyanine dyes, oxonol dyes, hemioxonol dyes, etc., can be used. Particularly useful dyes are cyanine dyes and merocyanine dyes.

As basic heterocyclic nuclei of the dyes, nuclei usually utilized for cyanine dyes can be applied. That is, pyrroline nuclei, oxazole nuclei, oxazoline nuclei, thiazole nuclei, thiazoline nuclei, pyrrole nuclei, selenazole nuclei, imidazole nuclei, tetrazole nuclei, pyridine nuclei, indole nuclei, benzoxazole nuclei, benzthiazole nuclei, benzoselenazole nuclei, benzimidazole nuclei, quinoline nuclei, etc., can be used.

The sensitizing dye is preferably used in an amount of from about $10^{-6}$ to $10^{-3}$ mol per mol of silver halide. Also, the sensitizing dye is added to the silver halide photographic material as a solution thereof in water or a suitable organic solvent such as alcohols miscible with water (e.g., methanol, ethanol, and methyl cellosolve), ketones (e.g., acetone), etc.

The silver halide photographic material for use in this invention comprises at least one hydrophilic colloidal layer containing a substantially surface latent image-type silver halide emulsion coated on a support and, if necessary, one or more light-insensitive hydrophilic colloidal layers such as a protective layer, an interlayer, an antihalation layer, a filter layer, etc., may be coated thereon. These hydrophilic colloidal layers contain an inorganic or organic hardening agent. As the hardening agent, chromium salts (e.g., chromium alum), aldehydes (e.g., formaldehyde and glyoxal), N-methylol compounds (e.g., dimethylolurea and methylol dimethylhydantoin), active halogen compounds (e.g., 2,4-dichloro-6-hydroxy-s-triazine, mucochloric acid), active vinyl compounds(e.g.,1,3,5-triacryloyl-hexahydro-5-triazine),epoxy hardening agents, and aziridine hardening agents can be used.

For the foregoing hydrophilic colloidal layers in this invention, if necessary, various kinds of photographic additives such as emulsion stabilizers (e.g., hydroxytetraazaindene compounds such as 6-hydroxy-4-methyl-1,3,3a,7-tetraazaindene, etc.), spreading agents (e.g., saponin), gelatin plasticizers (e.g., a copolymer of acrylic acid ester), various kinds of surfactants (e.g., cationic, anionic, nonionic, and amphoteric surfactants) for various purposes such as anti-static function, coating aid, and the improvement of photographic characteristics (e.g., development acceleration and the increase of contrast), matting agents, water-insoluble or sparingly water-soluble polymer latexes (e.g., the homo or copolymers of an alkyl acrylate, alkyl methacrylate, acrylic acid, glycidyl acrylate, etc.) for improving the dimensional stability of the photographic light-sensitive material can be used in the range so that the effects of the present invention are not reduced.

Then, the invention is described more practically by referring to the following examples but the invention is not limited to them in the scope of the invention.

EXAMPLE 1

By simultaneously adding an aqueous solution of silver nitrate and an aqueous solution of a mixture of potassium iodide, potassium bromide, and sodium chloride (I:Br:Cl=0.1:30:70), which contains $7.5\times10^{-8}$ mol of sodium rhodium (III) hexachloride per mol of silver, to an aqueous gelatin solution kept at 40° C. while keeping pAg at 7.2 over a period of 75 minutes, a cubic monodispersed silver chlorobromide emulsion containing 0.1 mol % silver iodide having a mean grain size of 0.28 μm was prepared. After removing soluble salts by an ordinary method, $4\times10^{-5}$ mol of sodium thiosulfate per mol of silver halide and $1\times10^{-5}$ mol of chloroauric acid per mol of silver halide were added to the emulsion and the emulsion was chemically ripened for 60 minutes at 48° C. The silver halide emulsion contained 80 g of gelatin per mol of silver halide. Then, after adding $6\times10^{-3}$ mol of 6-hydroxy-4-methyl-1,3,3a,7-tetraazaindene as an emulsion stabilizer, $3.5\times10^{-4}$ mol of 3,3'-dimethylthiazolino-carbocyanine methylsulfate as a sensitizing dye, $5\times10^{-2}$ mol of hydroquinone as an antifoggant, 2.5 g of nonylphenyl-polyethylene oxide (P-8) per mol of silver halide, and the heterocyclic thione compound as shown in Table 1 below to the silver halide emulsion thus prepared, the emulsion was coated on a polyethylene terephthalate (PET) base at a silver coverage of 40 mg/dm$^2$. The emulsion layer was protected by a gelatin protective layer containing formaldehyde and dimethylolurea as hardening agents.

Also, as comparative examples, a silver halide emulsion not containing the sensitizing dye, nonylphenyl-polyethylene oxide, and the heterocyclic thione compound in the foregoing additives (Comparison Example 1), a silver halide emulsion containing the sensitizing dye only (Comparison Example 2), a silver halide emulsion containing nonylphenylpolyethylene oxide only (Comparison Example 3), and a silver halide emulsion containing the sensitizing dye and nonylphenyl-polyethylene oxide but not containing the heterocyclic thione compound (Comparison Example 4) were prepared.

TABLE 1

| Film No. | Sensitizing Dye | PEO | Heterocyclic Thione Compound | |
|---|---|---|---|---|
| | | | Compound | Amount |
| 1 | none | none | — | — |
| 2 | added | none | — | — |
| 3 | none | P-8 | — | — |
| 4 | added | P-8 | — | — |
| 5 | added | P-8 | II-1 | 50 mg |
| 6 | added | P-8 | III-10 | 12 mg |
| 7 | added | P-8 | IV-7 | 33 mg |

PEO: Polyalkylene oxide
Nos. 1 to 4: Comparative Examples
Nos. 5 to 7: Examples of this invention
The amount is per mol equivalent of silver Samples for evaluating the photographic characteristics were prepared as follows. That is, each of the light-sensitive films prepared as described above was exposed for 5 seconds through a step wedge having a step difference of 0.15 to a tungsten light source of 2666 K using an LB-200 filter, then developed for 1 minute and 45 seconds at 27° C. using developer 1 having the following composition according to the invention, and stopped, fixed, washed and dried.

| Composition of Developer 1 | |
|---|---|
| Metol | 2.5 g |
| Sodium ascorbate (V-1) | 10.5 g |
| Sodium metaborate.4$H_2O$ | 35.0 g |
| Potassium Bromide | 1.0 g |
| Tetramethylammonium Chloride (VI-1) | 2.5 g |
| 5-Nitroindazole (I-1) | 1.5 mg |
| Water to make | 1 liter |
| pH | 10.8 |

Also, samples for dot image quality evaluation were prepared as follows. That is, each of the light-sensitive films was exposed for 3 seconds through a gray contact screen of 133 lines/inch using a tungsten light source of 100 volts, 500 watts, developed for 1 minute and 45 seconds at 27° C. with developer I described above, and stopped, fixed, washed, and dried.

The results of the evaluation of the photographic characteristics are shown in Table 2.

TABLE 2

| Film No. | Photographic Characteristics | | | | |
|---|---|---|---|---|---|
| | Relative Sensitivity | Fog | Gamma | Pepper | Dot Quality |
| 1 | 35 | 0.04 | 4.1 | A | E |
| 2 | 100 | 0.04 | 6.2 | A | D |
| 3 | 45 | 0.04 | 5.6 | A | E |
| 4 | 335 | 0.05 | 17.3 | A | A/B |
| 5 | 382 | 0.05 | 22.0 | A | A |
| 6 | 400 | 0.06 | 22.5 | A | A |
| 7 | 415 | 0.05 | 23.7 | A | A |

Nos. 1 to 4: Comparative Examples
Nos. 5 to 7: Examples of this invention

In Table 2, the relative sensitivity is the relative value of the reciprocal of the exposure amount for giving the density of 3.0 excluding fog with the sensitivity of Comparative Example 2 being defined as 100.

The gamma is shown by an average slope between the densities 0.5 and 3.0 each excluding fog.

The pepper susceptibility was evaluated by observing the unexposed area of each film with "lupe" (magnifying glass) of 50 magnifications, which was evaluated in 5 grades, wherein grade A shows the best quality (substantially free from any pepper) and grade E shows the worst quality. Grades A and B are suitable for practical use, Grade C is low quality but somehow in an allowable range for practical use, and grades D and E are unsuitable for practical use.

In the evaluation of the dot quality, each dot is observed by a microscope, the dot having sharp edge without fringe, if any very small of fringe is evaluated as grade A, the dot having many fringes is evaluated as grade E, and the grade between A and E is classified into 3 grades, B, C and D. In the evaluation, grade A is good, grade B is suitable for practical use, grade C is low but somehow in an allowable range for practical use, and grades D and E are unsuitable for practical use.

As is clear from Table 2, it can be seen that the addition of the heterocyclic thione compound together with a sensitizing dye and polyalkylene oxide to a light-sensitive film according to the process of this invention affords superhigh contrast negative images having a good dot quality. On the other hand, it can be seen that when any one of the three components just described above is not contained in a light-sensitive film, superhigh contrast negative images are not obtained.

EXAMPLE 2

A silver chloroiodobromide emulsion was prepared by the same procedure as in Example 1 and to the emulsion were added $7.5\times10^{-3}$ mol of 6-hydroxy-4-methyl-1,3,3a,7-tetraazaindene as an emulsion stabilizer, $3.5\times10^{-4}$ mol of 3,3'-dimethylthiazolino-carbocyanine methylsulfate as a sensitizing dye, $5\times10^{-2}$ mol of hydroquinone as an anti-foggant, and 12 mg of the heterocyclic thione compound (III-10) for use in this invention per mol of silver halide.

The emulsion was split into two portions, and after adding 2.5 g of nonylphenylpolyethylene oxide (P-8) per mol of silver halide to one of the emulsions thus split (the film using the emulsion is defined as "film No. 8"), each of the emulsions was coated on a polyethylene terephthalate (PET) base at a silver coverage of 40 mg/dm$^2$.

Each of the emulsion layers was protected by a gelatin protective layer containing formaldehyde and dimethylolurea as hardening agents.

In addition, the light-sensitive film without containing nonylphenylpolyethylene oxide was defined as film No. 9.

Each of films 8 and 9 thus prepared was exposed as in Example 1, developed for 1 minute and 45 seconds at 27° C. with developer 1 in Example 1 or developer 2 (this invention) having the following composition, i.e., prepared by adding the polyalkylene oxide (P-8) to developer 1, followed by the post treatments as in Example 1 to provide samples for the evaluation of photographic characteristics in each case.

| Composition of Developer 2 | |
|---|---|
| Metol | 2.5 g |
| Sodium Ascorbate (V-1) | 10.5 g |
| Sodium Metaborate.4$H_2O$ | 35.0 g |
| Potassium Bromide | 1.0 g |
| Tetramethylammonium Chloride (VI-1) | 2.5 g |
| 5-Nitroindazole (I-1) | 1.5 mg |
| Nonylphenylpolyethylene Oxide (P-8) | 1.5 g |
| Water to make | 1 liter |
| pH | 10.8 |

Each of the samples was evaluated as in Example 1 and the results obtained are shown in Table 3 below.

TABLE 3

| | | Photographic Characteristics | | | | | |
|---|---|---|---|---|---|---|---|
| Developer No. | Film No. | Relative Sensitivity | Gamma | Fog | Pepper | Dot Quality | Remarks |
| 1 | 8 | 100 | 22.0 | 0.06 | A | A | I |
| 1 | 9 | 38 | 7.3 | 0.05 | A | D | C |
| 2 | 8 | 103 | 22.5 | 0.06 | A | A | I |
| 2 | 9 | 91 | 14.7 | 0.06 | A | A/B | I |

I: This Invention
C: Comparative Example

In Table 3, the relative sensitivity is shown by a relative value with the sensitivity of the film No. 8 obtained by developing with developer 1 being defined as 100. Other photographic characteristics were same as those in Example 1.

As is clear from Table 3, according to the process of this invention, if the polyalkylene oxide derivative exists during development processing, superhigh contrast negative images having a good dot quality can be formed by proceeding the increase of the contrast even if the derivative exists in either the film or the developer.

EXAMPLE 3

Using each of film Nos. 4, 5, 6 and 7 prepared in Example 1 and film No. 9 prepared in Example 2, the test was performed by using developer 1, developer 2, or developer 3 having the following composition.

| Composition of Developer 3 (comparison) | |
|---|---|
| Metol | 2.5 g |
| Sodium Ascorbate (V-1) | 10.5 g |
| Sodium Metaborate.4$H_2O$ | 35.0 g |
| Potassium Bromide | 1.0 g |
| Water to make | 1 liter |
| pH | 10.8 |

According to the method of preparing samples for the dot quality evaluation in Example 1, each of the foregoing films was exposed, developed with the developer described above while changing the development time to 1 minute and 30 seconds, 1 minute and 45 seconds, or 2 minutes, and stopped, fixed, washed, and dried to provide samples for evaluation.

The dot quality of each sample was evaluated by the method in Example 1 and the results obtained are shown in Table 4 below.

TABLE 4

| Condition | | | Results of Evaluation of Dot Quality Development Time | | |
|---|---|---|---|---|---|
| Film No. | Developer No. | Remarks | 1 min. and 30 sec. | 1 min. and 45 sec. | 2 min. |
| 5 | 1 | Invention | A | A | A/B |
| 6 | 1 | Invention | A | A | A/B |
| 7 | 1 | Invention | A | A | A/B |
| 5 | 2 | Invention | A | A | A |
| 6 | 2 | Invention | A | A | A |
| 7 | 2 | Invention | A | A | A |
| 9 | 2 | Invention | A/B | A/B | A/B |
| 4 | 1 | Comparison | C | A/B | C |
| 5 | 3 | Comparison | C | B | D |

As is clear from Table 4, according to the process of this invention, the development tolerance (latitude) is wide and a good dot quality can be stably obtained. On the other hand, in the case of comparison examples lacking in the factor of this invention, the development tolerance is narrow and it is difficult to obtain a good dot quality. In addition, in the process of this invention, no pepper was observed in each case.

EXAMPLE 4

By simultaneously adding an aqueous solution of silver nitrate and an aqueous potassium bromide solution containing $3.0\times10^{-7}$ mol of sodium rhodium (III) hexabromide per mol of silver to an aqueous gelatin solution kept at 60° C. while keeping pAg at 7.0 over a period of 60 minutes, a monodispersed silver bromide emulsion containing cubic silver bromide grains having a mean grain size of 0.22 μm was prepared. After removing soluble salts by an ordinary method, $25\times10^{-5}$ mol of sodium thiosulfate per mol of silver halide was added to the emulsion and the emulsion was chemically ripened for 70 minutes at 60° C. The emulsion contained 80 g of gelatin per mol of silver halide. To the silver halide emulsion thus prepared were added $12\times10^{-3}$ mol of 6-hydroxy-4-methyl-1,3,3a,7-tetraazaindene, $4.2\times10^{-4}$ mol of 3,3'-dimethylthiazolinocarbocyanine methylsulfate, and nonylphenylpolyethylene oxide (P-8) and the heterocyclic thione compound for use in this invention shown in Table 5 per mol of silver halide.

TABLE 5

| Film | PEO | | Heterocyclic Thione Compound | |
|---|---|---|---|---|
| No. | Compound | Amount | Compound | Amount |
| 10 | P-8 | 2.5 g | — | |
| 11 | — | — | II-1 | 50 mg |
| 12 | — | — | III-10 | 12 mg |
| 13 | P-8 | 2.5 g | II-1 | 50 mg |
| 14 | P-8 | 2.5 g | II-6 | 50 mg |
| 15 | P-8 | 2.5 g | III-4 | 5 mg |
| 16 | P-8 | 2.5 g | III-10 | 12 mg |
| 17 | P-8 | 2.5 g | IV-1 | 18 mg |
| 18 | P-8 | 2.5 g | IV-7 | 33 mg |

Note): PEO means polyalkylene oxide.
The addition amount is the value of 1 mol silver equivalent of emulsion.

Each of the silver halide emulsion was coated on a polyethylene terephthalate (PET) base at a silver coverage of 40 mg/dm$^2$. Furthermore, each emulsion layer was protected by a gelatin protective layer containing formaldehyde and dimethylolurea as hardening agents to provide film Sample Nos. 10 to 18.

Then, according to the method of preparing samples for the dot quality evaluation in Example 1, each sample was exposed, developed with developer 1 or developer 2 used in Example 3 while changing the development time to 1 minute and 30 seconds, 1 minute and 45 seconds, or 2 minutes, and stopped, fixed, washed and dried to provide samples for evaluation.

The dot quality of each sample was evaluated by the method in Example 1 and the results obtained are shown in Table 6.

TABLE 6

| Condition | | | Results of Evaluation of Dot Quality Development Time | | |
|---|---|---|---|---|---|
| Film No. | Developer No. | Remarks | 1 min. and 30 sec. | 1 min. and 45 sec. | 2 min. |
| 10 | 1 | Comparison | C | B | C |
| 11 | 1 | Comparison | C | C | D |
| 12 | 1 | Comparison | C | C | D |
| 10 | 2 | Comparison | B | A/B | B |
| 11 | 2 | Invention | A/B | A | A/B |
| 12 | 2 | Invention | A/B | A | A/B |
| 13 | 1 | Invention | A | A | A |
| 14 | 1 | Invention | A | A | A |
| 15 | 1 | Invention | A | A | A |
| 16 | 1 | Invention | A | A | A |
| 17 | 1 | Invention | A | A | A |
| 18 | 1 | Invention | A | A | A |

As is clear from Table 6, it can be seen that according to the image-forming process of this invention, the development tolerance (latitude) is wide and a good dot quality can be stably obtained, but in the case of comparative examples which do not meet the conditions of this invention, a sufficient dot quality can not be obtained.

As described above, according to the image-forming process of this invention, negative images of superhigh contrast having gamma over 10 and having less formation of pepper can be obtained. Furthermore, the process of this invention is an excellent image-forming process capable of obtaining a good dot quality with a wide tolerance for development, and in particular, images of good quality useful for photomechanical process for printing.

While the invention has been described in detail and with reference to specific embodiments thereof, it will be apparent to one skilled in the art that various changes and modifications can be made therein without departing from the spirit and scope thereof.

What is claimed is:

1. A process of forming superhigh-contrast negative images which comprises the steps of imagewise exposing a substantially surface latent image-type silver halide photographic material which is spectrally sensitized with a sensitizing dye and then developing said photographic material with a developer, wherein said photographic material contains a heterocyclic thione compound and said developer comprises (a) an aminophenol derivative developing agent, (b) a reductone compound, (c) a quaternary ammonium salt, and (d) a compound represented by formula (I):

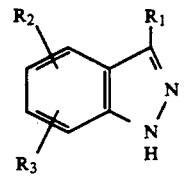

(I)

wherein $R_1$, $R_2$ and $R_3$, which may be the same or different, each represents a hydrogen atom, a nitro group, a halogen atom, or a cyano group, and wherein said development processing is carried out in the existence of at least one kind of a polyalkylene oxide or a derivative thereof.

2. The superhigh contrast negative image-forming process according to claim 1, wherein the heterocyclic thione compound is an ethylenethiourea derivative represented by formula (II) or the tautomer thereof:

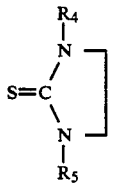

(II)

wherein $R_4$ and $R_5$ each represents a hydrogen atom, an alkyl group, an aralkyl group, or a substituted or unsubstituted aryl group.

3. The superhigh contrast negative image-forming process according to claim 1, wherein the heterocyclic thione compound is a tetrahydro-1,3,5-triazine-2-thione derivative represented by formula (III) or (IV):

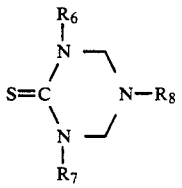

(III)

wherein $R_6$ and $R_7$ each independently represents a hydrogen atom or an alkyl group and $R_8$ represents a substituted or unsubstituted monovalent organic group;

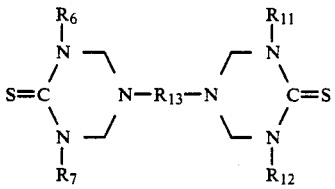

(IV)

wherein $R_9$, $R_{10}$, $R_{11}$ and $R_{12}$ each independently represents a hydrogen atom or an alkyl group and $R_{13}$ represents a substituted or unsubstituted divalent organic group.

4. The superhigh contrast negative image-forming process according to claim 1, wherein the addition amount of the heterocyclic thione compound is in the range of from $1\times10^{-8}$ to $1\times10^{-2}$ mol per mol of silver halide.

5. The superhigh contrast negative image-forming process according to claim 1, wherein the addition amount of the heterocyclic thione compound is in the range of from $1\times10^{-5}$ to $1\times10^{-3}$ mol per mol of silver halide.

6. The superhigh contrast negative image-forming process according to claim 1, wherein the reductone compound is represented by formula (V):

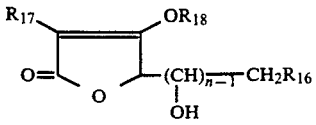

(V)

wherein $R_{16}$ represents a hydrogen atom or a hydroxy group; n represents an integer of from 1 to 4; $R_{17}$ represents a hydroxy group, an alkoxy group having from 1 to 4 carbon atoms, a thiol group, or an amino group; and $R_{18}$ represents a hydrogen atom or an alkyl group having from 1 to 4 carbon atoms.

7. The superhigh contrast negative image-forming process according to claim 1, wherein the addition amount of the reductone compound is in the range of from 5 g to 20 g per liter of said developer.

8. The superhigh contrast negative image-forming process according to claim 1, wherein the quaternary ammonium salt is represented by formula (VI):

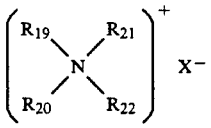

(VI)

wherein $R_{19}$, $R_{20}$, $R_{21}$ and $R_{22}$, which may be the same or different, each represents a straight chain or branched alkyl group having from 1 to 4 carbon atoms or an alkenyl group and $X^-$ represents an anion.

9. The superhigh contrast negative image-forming process according to claim 1, wherein the addition amount of the quaternary ammonium salt is in the range of from 0.01 mol to 0.05 mol per liter of said developer.

10. The superhigh contrast negative image-forming process according to claim 1, wherein the addition amount of the compound represented by formula (I) is not more than 100 mg per liter of said developer.

11. The superhigh contrast negative image-forming process according to claim 1, wherein the addition amount of the compound represented by formula (I) is in the range of from 0.5 mg to 10 mg per liter of said developer.

12. The superhigh contrast negative image-forming process according to claim 1, wherein the polyalkylene oxide or the derivative thereof is contained in said photographic material in an amount of from 0.5 g to 3 g per mol of silver halide.

13. The superhigh contrast negative image-forming process according to claim 1, wherein the polyalkylene oxide or the derivative thereof is contained in said developer in an amount of from 0.1 g to 5 g per liter.

14. The superhigh contrast negative image-forming process according to claim 6, wherein the reductone compound is represented by the following formula:

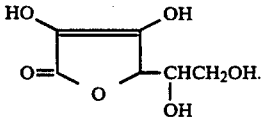

15. The superhigh contrast negative image-forming process according to claim 1, wherein the pH value of said developer is in the range of from 9 to 11.

* * * * *